US008057361B2

(12) United States Patent
McBride et al.

(10) Patent No.: US 8,057,361 B2
(45) Date of Patent: Nov. 15, 2011

(54) PORTABLE WORKOUT APPARATUS INCLUDING A PLIE BAR

(75) Inventors: Robert W. McBride, Springfield, MO (US); Robert McDonial, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 895 days.

(21) Appl. No.: 11/329,252

(22) Filed: Jan. 11, 2006

(65) Prior Publication Data

US 2006/0160681 A1 Jul. 20, 2006

Related U.S. Application Data

(60) Provisional application No. 60/642,985, filed on Jan. 12, 2005.

(51) Int. Cl.
*A63B 21/00* (2006.01)

(52) U.S. Cl. ..... 482/15; 482/17

(58) Field of Classification Search ..... 482/14–18, 482/35, 23, 34, 36, 37, 38, 39, 40, 41, 140, 482/121–130, 142
See application file for complete search history.

(56) References Cited

U.S. PATENT DOCUMENTS

| | | | | |
|---|---|---|---|---|
| 676,784 | A | 8/1901 | Ryan | |
| 885,240 | A | 4/1908 | Graham | 285/130.1 |
| 889,223 | A | 6/1908 | Graham | 52/653.2 |
| 1,261,213 | A | 4/1918 | Clay | 403/233 |
| 2,267,376 | A | 12/1941 | Malm | |
| 2,632,645 | A | 3/1953 | Barkschat | |
| 2,711,917 | A | 6/1955 | Blu | 403/171 |
| 2,885,233 | A | 5/1959 | Horowitz | 403/170 |
| 3,062,570 | A | 11/1962 | Schwartz | 403/172 |
| 3,218,661 | A | 11/1965 | Fielder, Jr. | 15/145 |
| 3,226,115 | A | 12/1965 | Underhill | |
| 3,501,140 | A | 3/1970 | Eichorn | 272/60 |
| 3,709,487 | A * | 1/1973 | Walker | 482/133 |
| 3,851,874 | A | 12/1974 | Wilkin | |
| 3,874,657 | A | 4/1975 | Niebojewski | |
| 4,136,984 | A | 1/1979 | Hayashi | 403/170 |
| 4,245,838 | A * | 1/1981 | Gordon | 482/17 |
| 4,256,300 | A | 3/1981 | Boucher | 472/118 |

(Continued)

FOREIGN PATENT DOCUMENTS

| | | |
|---|---|---|
| CH | 577327 | 5/1976 |

(Continued)

OTHER PUBLICATIONS

Search Report for PCT International Appln. No. PCT/US2006/000814, dated Feb. 6, 2006.

(Continued)

*Primary Examiner* — Jerome W Donnelly
(74) *Attorney, Agent, or Firm* — Pillsbury Winthrop Shaw Pittman LLP

(57) ABSTRACT

A portable workout apparatus comprising a bar, a frame, and a padded structured secured to the frame. The bar is held at an adjustable bar height. The frame supports the bar at the adjustable bar height. The padded structure is secured to the frame, and has a first portion and a second portion. The first and second portions have a deployed position forming a substantially horizontal surface that forms an opening with the bar and the frame that is adapted to accommodate a user. The first portion is further capable of pivoting, relative to the second portion, to a substantially vertical position for storage.

2 Claims, 17 Drawing Sheets

U.S. PATENT DOCUMENTS

| | | | | | |
|---|---|---|---|---|---|
| 4,257,590 | A | | 3/1981 | Sullivan et al. | 272/117 |
| 4,300,761 | A | | 11/1981 | Howard | |
| 4,369,966 | A | | 1/1983 | Silberman | |
| 4,431,181 | A | | 2/1984 | Baswell | 272/62 |
| 4,634,127 | A | | 1/1987 | Rockwell | |
| 4,635,926 | A | | 1/1987 | Minkow | |
| 4,691,918 | A | | 9/1987 | Rockwell | |
| 4,721,303 | A | | 1/1988 | Fitzpatrick | |
| 4,747,594 | A | | 5/1988 | Houde | |
| 4,804,179 | A | | 2/1989 | Murphy | |
| 4,811,946 | A | | 3/1989 | Pelczar | |
| 4,826,157 | A | | 5/1989 | Fitzpatrick | 272/134 |
| 4,830,363 | A | | 5/1989 | Kennedy | |
| 4,844,448 | A | | 7/1989 | Niznik | 482/40 |
| 4,850,586 | A | | 7/1989 | Horvath | |
| 4,907,798 | A | | 3/1990 | Burchatz | |
| 4,921,242 | A | | 5/1990 | Watterson | |
| 4,976,428 | A | | 12/1990 | Ghazi | |
| 5,013,035 | A | | 5/1991 | Nathaniel | 482/129 |
| 5,090,694 | A | | 2/1992 | Pauls | |
| 5,141,480 | A | | 8/1992 | Lennox | |
| 5,263,916 | A | | 11/1993 | Bobich | |
| 5,320,591 | A | * | 6/1994 | Harmon et al. | 482/129 |
| 5,324,243 | A | | 6/1994 | Wilkinson | |
| 5,328,428 | A | | 7/1994 | Huang | |
| 5,403,253 | A | | 4/1995 | Gaylord | |
| 5,403,257 | A | | 4/1995 | Lehtonen | |
| 5,419,749 | A | | 5/1995 | Morgenstein | |
| 5,431,617 | A | | 7/1995 | Rattray, Jr. | |
| 5,468,205 | A | | 11/1995 | McFall | |
| 5,487,714 | A | | 1/1996 | Ferrari | |
| 5,522,784 | A | | 6/1996 | Grant | |
| 5,561,874 | A | | 10/1996 | Malofsky et al. | 5/99.1 |
| 5,626,546 | A | | 5/1997 | Little | 482/129 |
| 5,674,167 | A | | 10/1997 | Piaget | |
| 5,718,659 | A | | 2/1998 | VanStraaten | |
| 5,810,702 | A | | 9/1998 | Wilkinson | 482/142 |
| 5,842,961 | A | | 12/1998 | Davis | |
| 5,941,807 | A | | 8/1999 | Cassidy | |
| 6,015,369 | A | | 1/2000 | Rasmussen | |
| 6,110,083 | A | | 8/2000 | Riser | 482/142 |
| 6,142,919 | A | | 11/2000 | Jorgensen | |
| 6,159,133 | A | | 12/2000 | Shugg | |
| 6,228,004 | B1 | | 5/2001 | Steinbach | |
| 6,520,890 | B2 | | 2/2003 | Hsu | |
| 6,585,626 | B2 | | 7/2003 | McBride | |
| 6,595,905 | B2 | | 7/2003 | McBride | |
| 6,669,609 | B2 | | 12/2003 | Gerschefske et al. | 482/123 |
| 6,726,601 | B1 | | 4/2004 | Beutel | |
| 6,805,409 | B2 | * | 10/2004 | Parker | 297/377 |
| 6,971,975 | B2 | | 12/2005 | Croft | 482/121 |
| 7,101,326 | B2 | | 9/2006 | Gerschefske et al. | 482/129 |
| 7,104,937 | B2 | | 9/2006 | Arbuckle et al. | 482/142 |
| 7,125,369 | B2 | | 10/2006 | Endelman | 482/142 |
| 7,137,937 | B2 | | 11/2006 | Croft | 482/142 |
| 2001/0018387 | A1 | | 8/2001 | Webber | 482/142 |
| 2001/0056011 | A1 | * | 12/2001 | Endelman et al. | 482/121 |
| 2003/0186793 | A1 | | 10/2003 | Chen | 482/140 |
| 2005/0059536 | A1 | | 3/2005 | Croft | 482/123 |
| 2005/0164856 | A1 | | 7/2005 | Parmater | 482/142 |
| 2006/0003877 | A1 | | 1/2006 | Harmon | 482/142 |
| 2006/0122044 | A1 | | 6/2006 | Ho | 482/123 |
| 2006/0160681 | A1 | | 7/2006 | McBride et al. | 482/123 |
| 2006/0194680 | A1 | | 8/2006 | Croft | 482/123 |
| 2008/0248935 | A1 | | 10/2008 | Solow | 482/142 |
| 2009/0054215 | A1 | | 2/2009 | Mcbride et al. | 482/129 |

FOREIGN PATENT DOCUMENTS

| | | |
|---|---|---|
| EP | 507509 | 9/1920 |
| FR | 2234017 | 6/1973 |
| GB | 2257921 | 1/1993 |
| WO | WO 02/24281 | 3/2002 |

OTHER PUBLICATIONS

Search Report for PCT International Appln. No. PCT/US2006/000814, dated Jul. 25, 2006.

Search Report for PCT International Appln. No. PCT/US2006/000814, dated Jun. 2, 2006.

Bowflex Ultimate: Owner's Manual & Fitness Guide, Bowflex, Inc. 2001.

"Bowflex Motivator: Owner's Manual & Fitness Guide," Bowflex, Inc. 1997.

"Bowflex Power Pro: Owner's Manual & Fitness Guide,", Bowflex, Inc. 1997.

Wendy Marston, "Grace Under Pressure," Newsweek, Sep. 11, 2000.

* cited by examiner

PORTABLE WORKOUT APPARATUS INCLUDING A PLIE BAR

RELATED APPLICATIONS

This application claims priority from U.S. Provisional Patent No. 60/642,985, entitled, "Portable Workout Apparatus Including a Plie Bar," filed Jan. 12, 2005, and incorporated herein by reference.

FIELD OF THE INVENTION

The invention relates generally to a portable workout apparatus, and more specifically to a workout apparatus that includes a plie bar.

BACKFLOOR OF THE INVENTION

Plie bars are typically used in exercising and stretching muscles and joints. Conventional workout apparatus that provide a plie bar are fixed, or substantially fixed, in location in order to stabilize the plie bar under the load that may be applied to the bar by a user. Such systems lack portability and may be an inconvenient use of space when not in use. Some conventional configurations may not provide an opening underneath the plie bar to enable a user to pass back and forth under the bar. This may limit the number of exercises that may be performed. Other drawbacks to these and other workout apparatus that provide a plie bar exist.

SUMMARY

One aspect of the invention relates to a portable workout apparatus comprising a bar, a frame, and a padded structured secured to the frame. The bar is held at an adjustable bar height. The frame supports the bar at the adjustable bar height. The padded structure is secured to the frame, and has a first portion and a second portion. The first and second portions have a deployed position forming a substantially horizontal surface that forms an opening with the bar and the frame that is adapted to accommodate a user. The first portion is further capable of pivoting, relative to the second portion, to a substantially vertical position for storage.

Another aspect of the invention relates to a portable workout apparatus comprising a bar, a frame, a substantially horizontal padded structure, and a resilient elongated structure (e.g., a bungee cord). The bar is held at an adjustable bar height. The frame supports the bar at the adjustable bar height. The substantially horizontal padded structure is secured to the frame at a position lower than the bar. The resilient elongated structure one end fixed to a lower portion of the frame, and a loop at an opposite end.

Another aspect of the invention relates to a portable workout apparatus comprising a bar, a frame, a substantially horizontal padded structure, and a resilient elongated structure. The bar is held at an adjustable bar height. The frame supports the bar at the adjustable bar height. The substantially horizontal padded structure is secured to the frame at a position lower than the bar. The bar is held by a vertically adjustable frame portion. The resilient elongated structure has one end fixed to the adjustable frame portion and an opposite end terminating in a loop configuration.

Another aspect of the invention relates to a portable workout apparatus comprising a bar, a frame, a padded structure, and a releasable lock. The bar is held at an adjustable bar height. The frame supports the bar at the adjustable bar height. The padded structure is secured to the frame, and can be positioned horizontally to form an opening with the bar and the frame, the opening being adapted to accommodate a user. The padded structure includes a first portion and a second portion, the first portion being capable of pivoting, relative to the second portion, to a substantially vertical position for storage. The releasable lock is constructed to couple the first portion to the frame such that the first surface portion becomes fixed rotationally with respect to the frame in a substantially horizontal position, wherein coupling the first surface portion to the frame effectively increases the footprint of the frame.

DETAILED DESCRIPTION OF THE DRAWINGS

Figure 1:
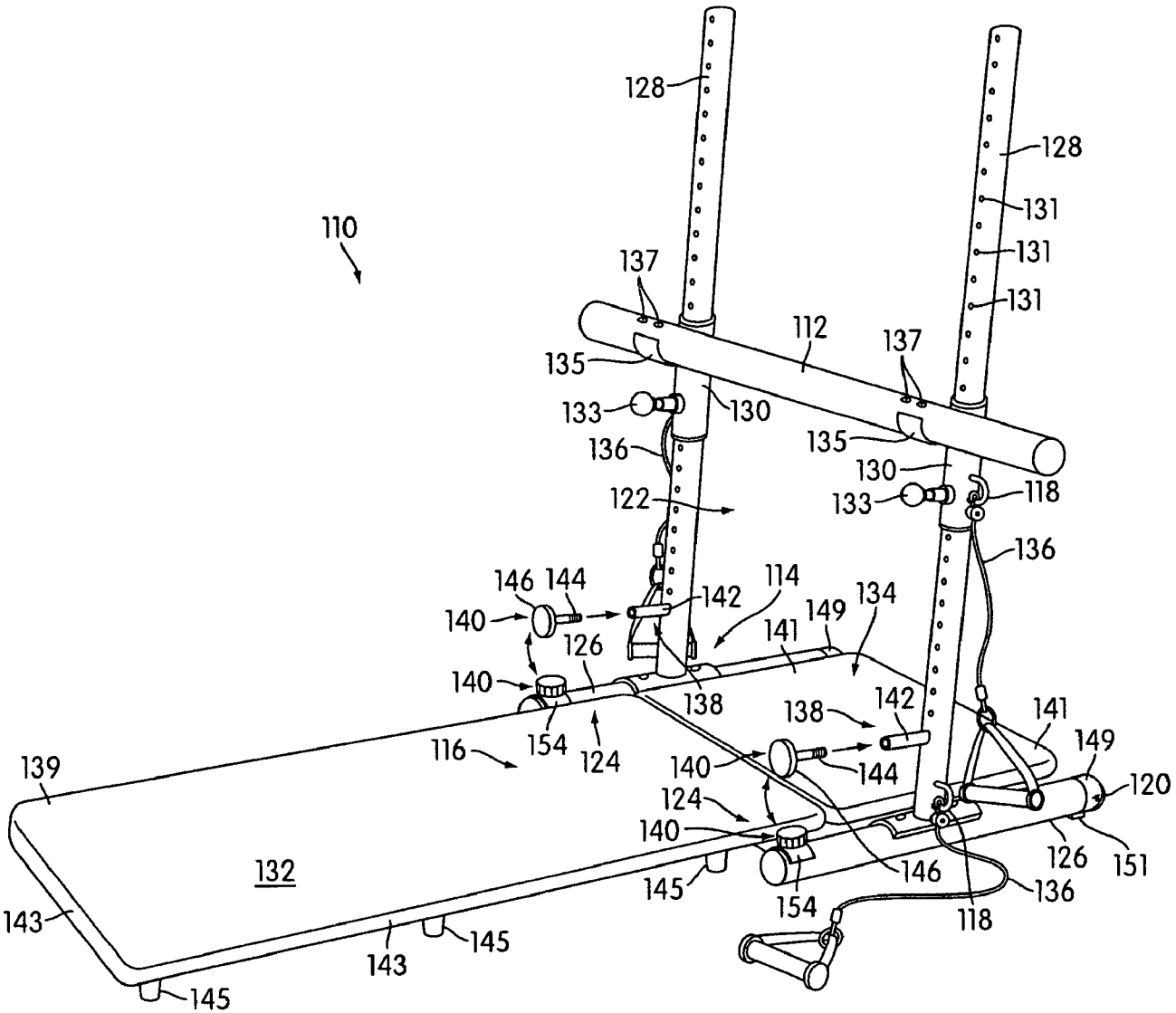
FIG. 1 illustrates a portable workout apparatus according to one or more embodiments of the invention.

FIGS. 1-4 illustrate an exemplary embodiment of a portable workout apparatus 110. Apparatus 110 may include a plie bar 112, a frame 114, a substantially planar or flat structure having a planar or flat surface 116, a plurality of cord brackets 118, and a plurality of wheels 120. Plie bar 112, frame 114, and structure 116 may form an opening 122.

In some embodiments of the invention, bar 112 may be provided at an adjustable bar height. This may enable a user to position bar 112 according to various considerations, such as, for example, a height of the user, an exercise to be performed, or other considerations. In a non-limiting example, bar 112 may have a round cross section, and may be 2 inches in diameter. In one embodiment, bar 112 is made of wood. In another embodiment, bar 112 is made of another relatively rigid material.

According to various embodiments of the invention, frame 114 may include a base 124, support members 128, and sliding bar brackets 130. Base 124 may include base members 126. Base 124 may engage the floor and may provide a stable foundation for frame 114. Support members 128 may extend out of base 124 to support bar 112. Sliding bar brackets 130 may be disposed along support members 128 and may hold bar 112. Sliding bar brackets 130 may enable the height of bar 112 to be adjusted by moving sliding bar brackets 130 along support members 128.

Figure 5:
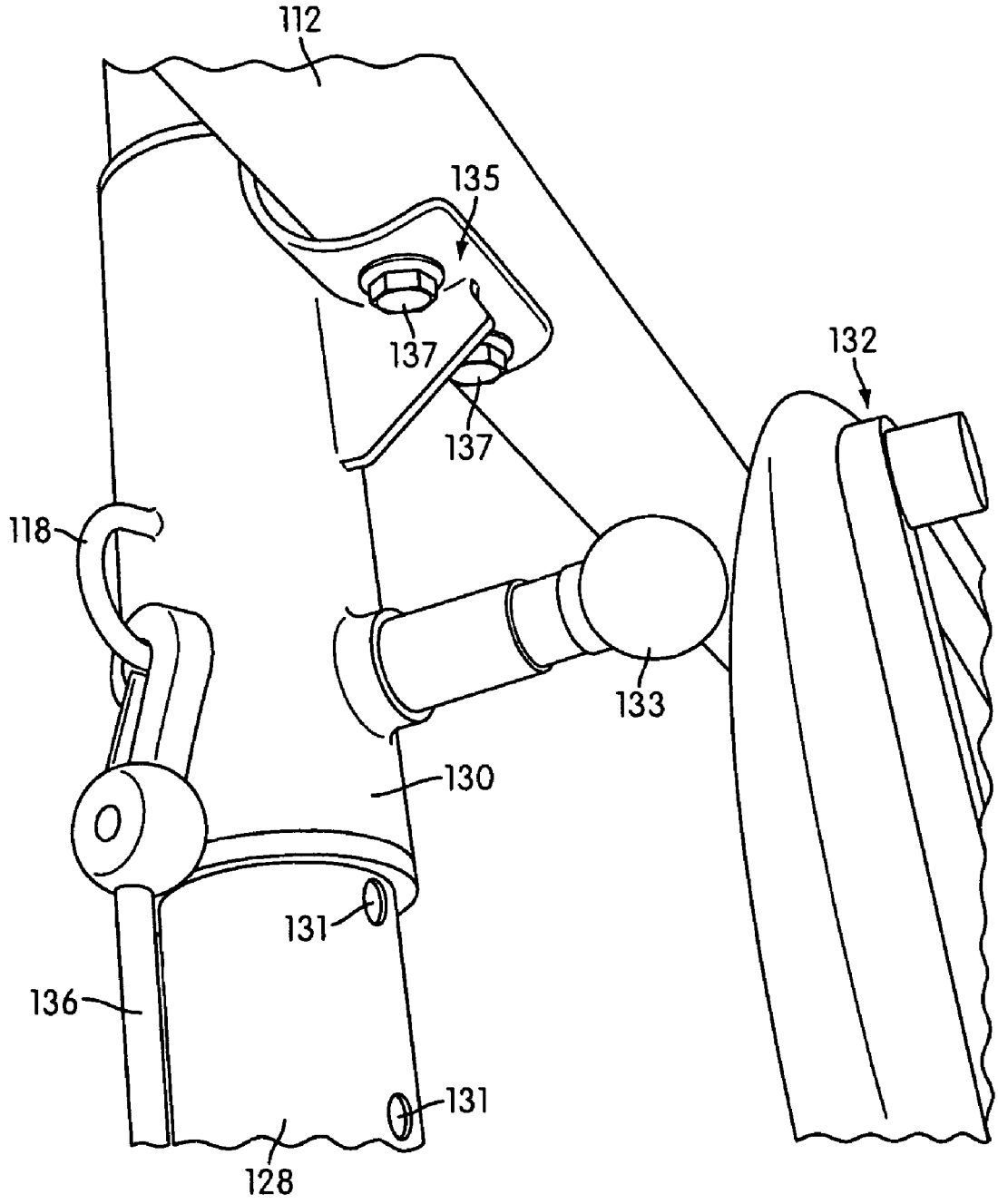
FIG. 5 illustrates a portable workout apparatus including a sliding bar bracket according to one or more embodiments of the invention.

FIG. 5 illustrates an exemplary embodiment of frame 114 including sliding bar bracket 130. In some embodiments, frame 114 may include support member openings 131 formed in support member 128. Sliding bar bracket 130 may be secured from sliding along support member 128 by a bracket pin 133. Bracket pin 133 may engage one of support member openings 131 to secure sliding bar bracket 130 with respect to support member 128. By engaging bracket pin 133 with a selected support member opening, a user may selectably configure the height at which bar 112 will be supported by frame 114. In one embodiment, bracket pin 133 includes a substantially spherical knob that the user can grasp while inserting bracket pin 133 into, or removing bracket pin 133 from, one of support member openings 131.

According to various embodiments, sliding bar bracket 130 may include a bar holding member 135 that holds bar 112. Bar 112 may be secured to bar holding member 135 via one or more fasteners, such as, for example bolts 137.

Figure 2:
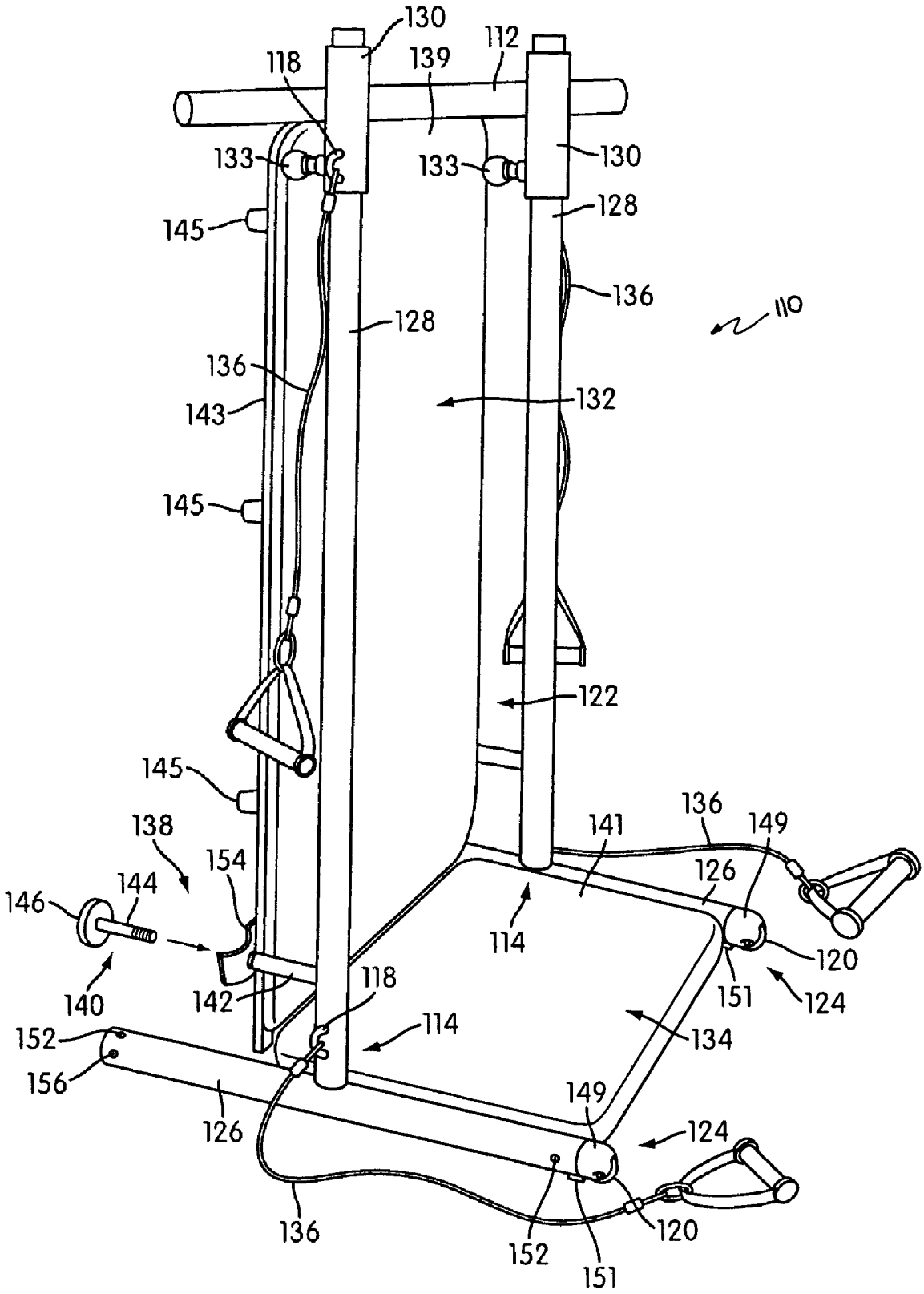
FIG. 2 illustrates a portable workout apparatus according to one or more embodiments of the invention.
Figure 3:
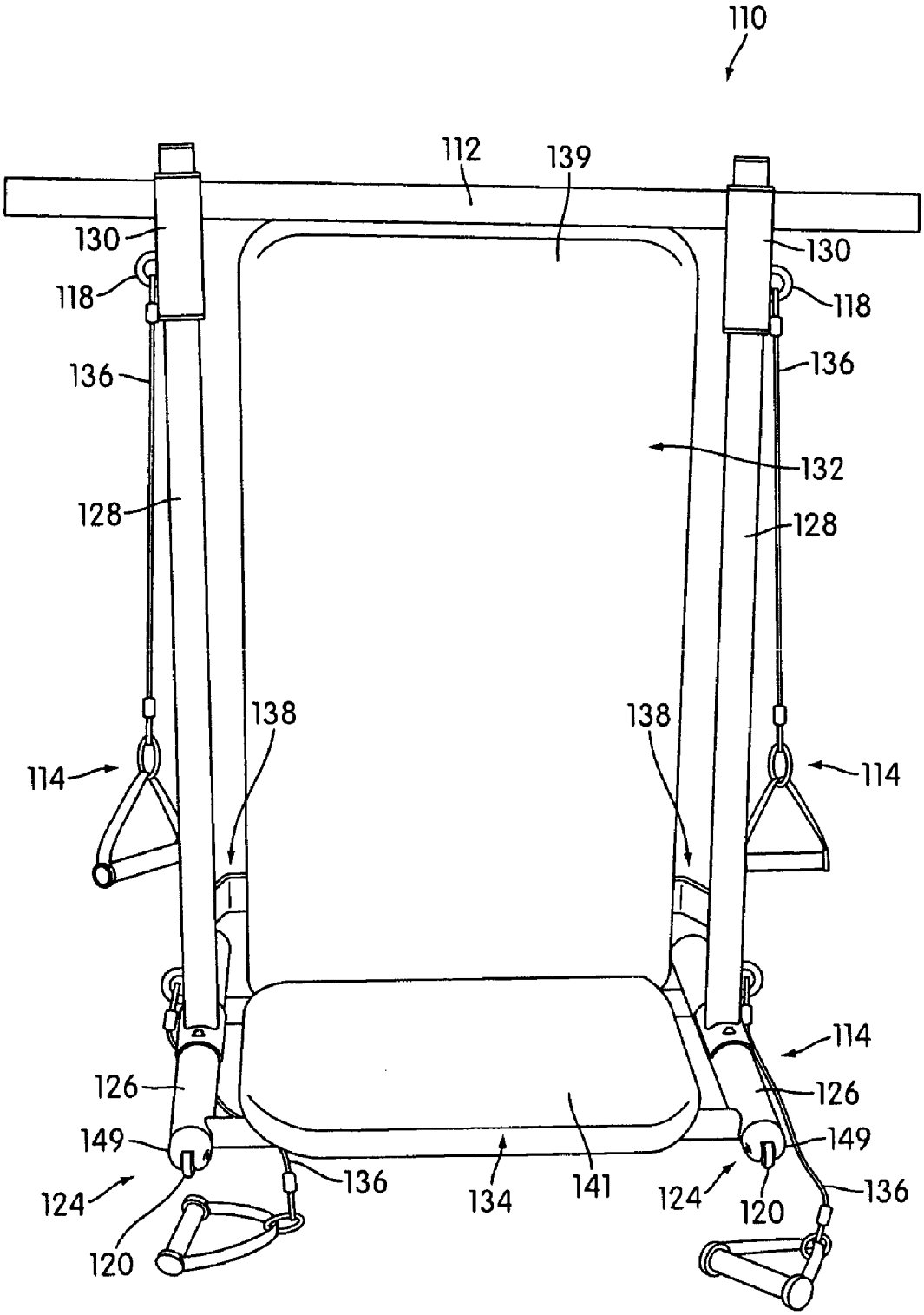
FIG. 3 illustrates a portable workout apparatus according to one or more embodiments of the invention.
Figure 4:
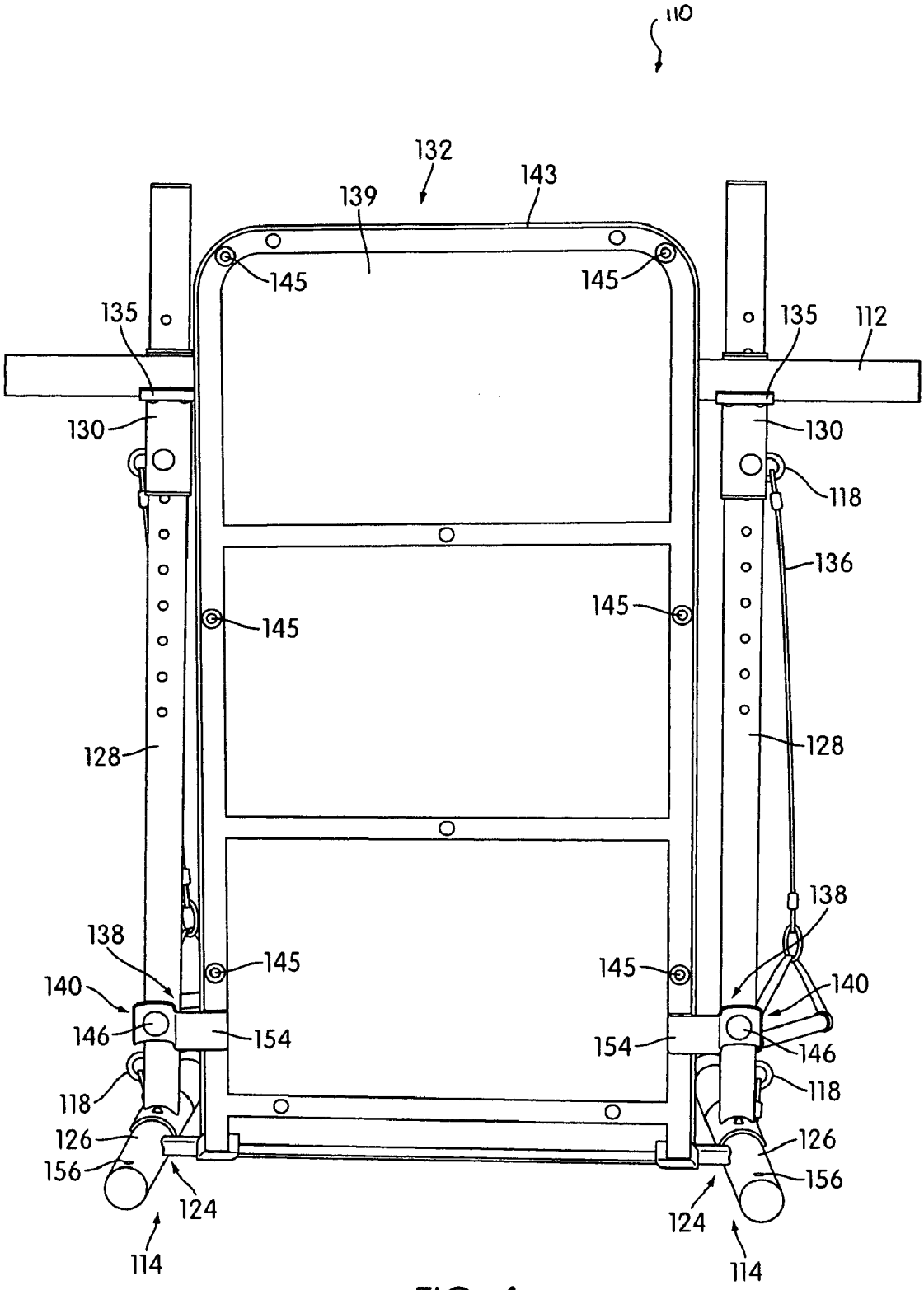
FIG. 4 illustrates a portable workout apparatus according to one or more embodiments of the invention.

In some embodiments of the invention, structure 116 may be positioned between support members 128, and may be operatively coupled to frame 114. Structure 116 may include a first surface portion 132 and a second surface portion 134. As is illustrated in FIG. 2, first surface portion 132 may pivot, independent of second surface portion 134, to a substantially vertical position for storage and transport. In some embodiments, first surface portion 132 may extend out from under bar 112 in a first direction and second surface portion 134 may extend out from under bar 112 in a second direction. First surface portion 132 may extend out further than second surface portion 134. When using apparatus 110, the user may stand, sit, lie, or otherwise be positioned on structure 116. This may provide ballast to apparatus 110 during an exercise. In other words, the force applied to structure 116 by the user's weight may enhance the stability of apparatus 110 when the exercise being performed by the user applies a load to apparatus 110.

According to various embodiments of the invention, first surface portion 132 and second surface portion 134 may include first padded member 139 and second padded member 141, respectively. First padded member 139 and second padded member 141 may provide structure 116. First padded member 139 and/or second padded member 141 may be substantially flat, or structure 116 may be contoured. For example, first padded member 139 and/or second padded member 141 may be contoured and/or padded to enhance a comfort of the user. Second padded member 141 may be supported by base members 126 (see, e.g., FIG. 3).

In some embodiments of the invention, first surface portion 132 may include a first surface portion frame 143 and first surface portion supports 145. First surface portion frame 143 may support first padded member 139. First surface portion supports 145 may be fixed to first surface portion frame 143, and may engage the floor. First surface portion supports 145 may constructed to provide stability to apparatus 110 via friction between engaged surfaces of first surface portion supports 145 and the floor. For example, first surface portion supports 145 may be constructed at least in part of a rubberized material, or another material selected to enhance friction between surface portion supports 145 and the floor.

According to various embodiments of the invention, opening 122, formed by bar 112, frame 114, and surface 116, may be large enough to accommodate the user within opening 122. In some instances, opening 122 may enable the user to pass back and forth under bar 112. An opening 122 of this size may enable various exercises in which the user may be positioned under bar 112 to be performed on apparatus 110. This may enhance the amount and/or types of exercises that may be performed by the user on apparatus 110.

Figure 6:
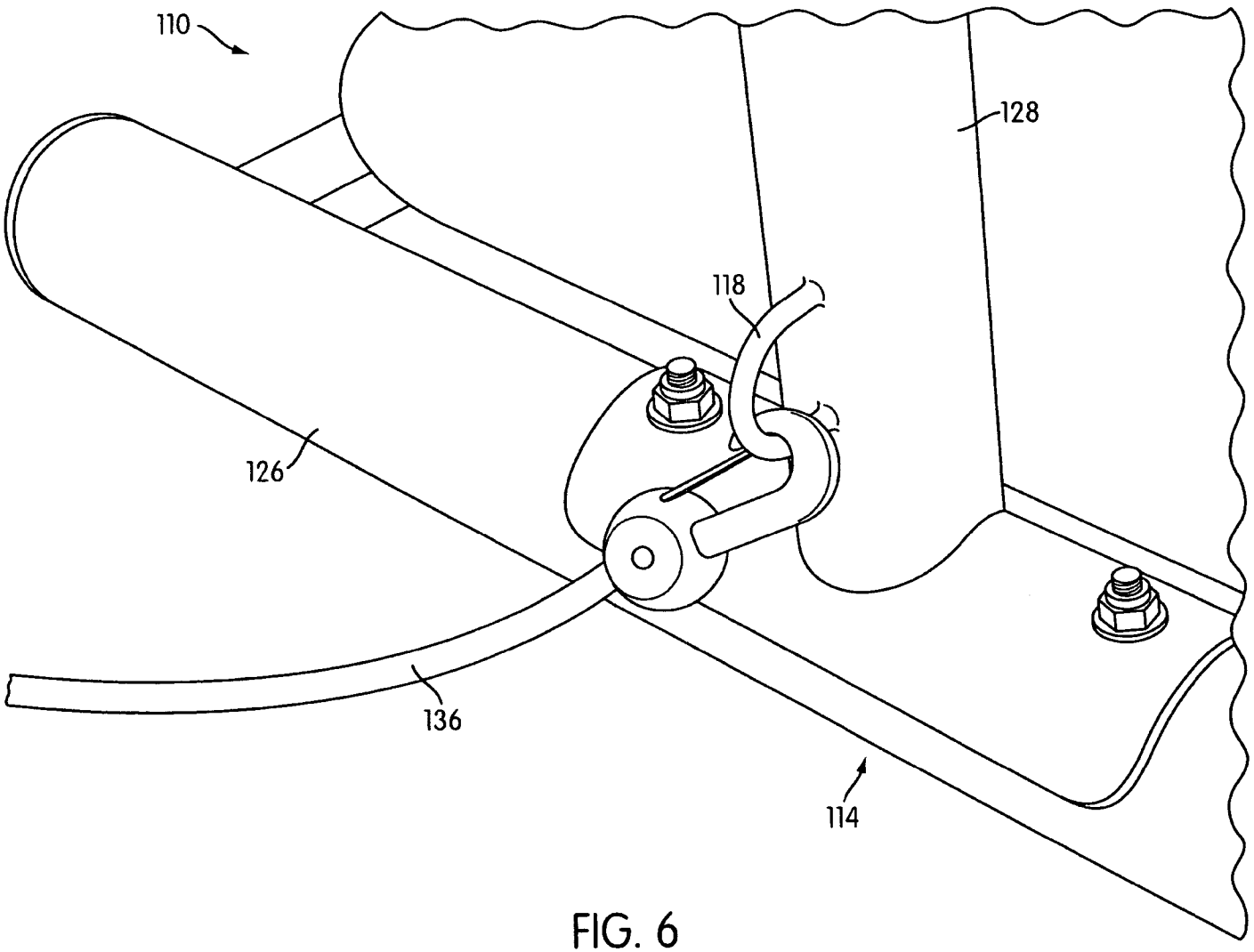
FIG. 6 illustrates a portable workout apparatus including a cord bracket according to one or more embodiments of the invention.
Figure 7:
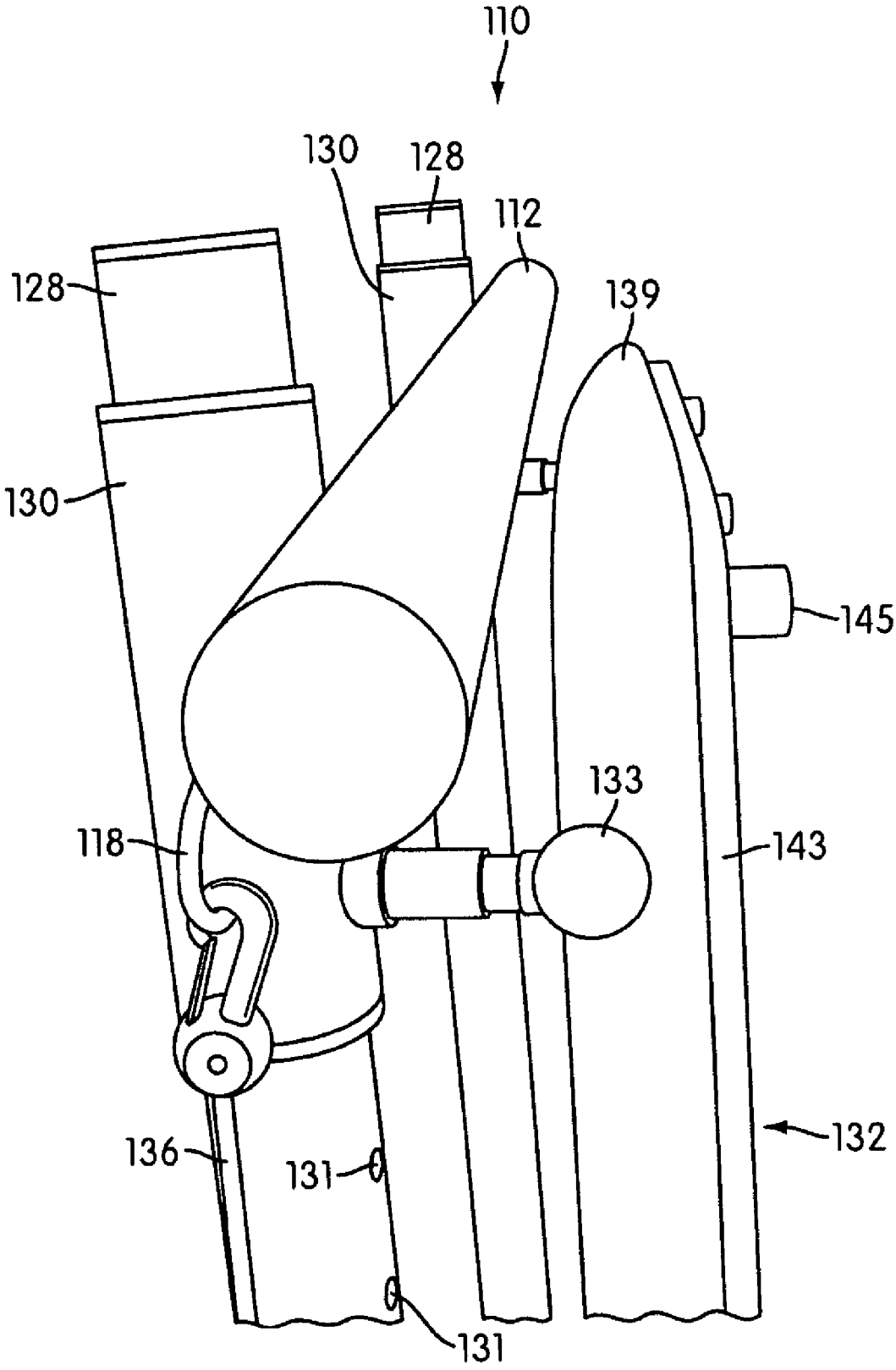
FIG. 7 illustrates a portable workout apparatus including a cord bracket according to one or more embodiments of the invention.

In some embodiments, cord brackets 118 may be adapted for attaching an end of a resistance cord 136. FIGS. 6 and 7 illustrate exemplary embodiments of cord brackets 118. The user may use resistance cords 136 to perform motions with resistance. Each resistance cords 136 may include a member that is resiliently elongated (e.g., a bungee cord). Cord brackets 118 may be configured such that resistance cords 136 may be selectively attached and detached to enable the user to select a level of resistance to be provided. For instance, cord brackets 118 may include a loop, a hook, or another mechanism for enabling selective attaching and detaching of resistance cords 136. Cord brackets 118 may be located on bar 112, frame 114, and/or surface 116. Cord brackets 118 may fixed. For example, as is illustrated in FIG. 6, cord brackets 118 may be fixed at a lower portion of support member 128. Or, one or more of cord brackets 118 may be positionable. For instance, cord brackets may be independently positionable, positionable with bar 112 (e.g. located on sliding bar brackets 130, as is illustrated in FIG. 7), or otherwise positionable.

Figure 8:
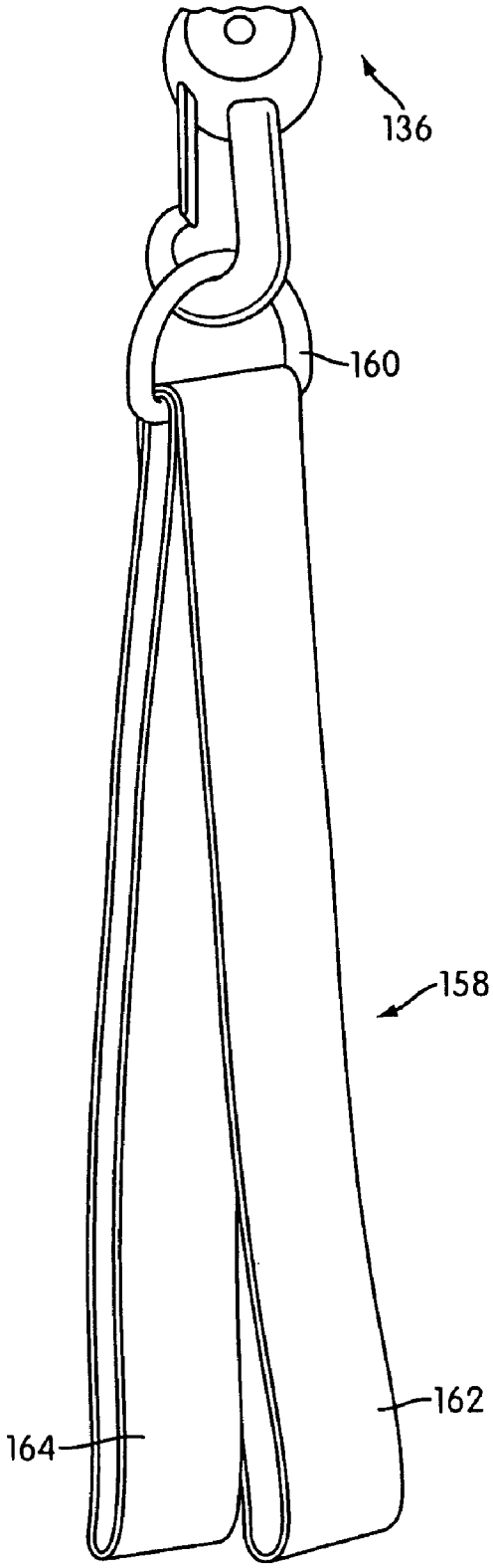
FIG. 8 illustrates a strap for use with a portable workout apparatus according to one or more embodiments of the invention.
Figure 9:
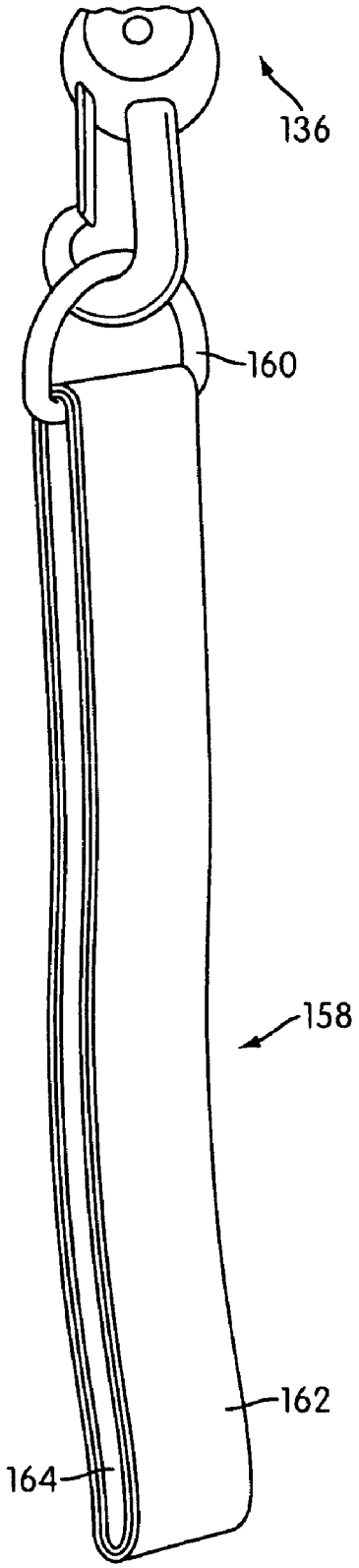
FIG. 9 illustrates a strap for use with a portable workout apparatus according to one or more embodiments of the invention.

In one embodiment of the invention, resistance cord 136 is releasably coupled with a strap 158 at an end of resistance cord 136 opposite the releasable attachment to cord bracket 118. Turning to FIG. 8, an exemplary illustration of strap 158, according to one embodiment of the invention, is shown. In the embodiment of FIG. 8, strap 158 includes a member 160 that can be engaged with resistance cord 136 to releasably couple resistance cord 136 to strap 158. FIG. 8 shows an outer loop 162 and an inner loop 164 of strap 158. Outer loop 162 and inner loop 164 are formed from a pliable material, and are connected to member 160. In one embodiment, outer loop 162 and inner loop 164 are formed from a woven material. FIG. 9 illustrates strap 158, in accordance with on embodiment of the invention, positioned so that inner loop 164 is positioned within outer loop 162. In one embodiment of the invention, loops 162 and 164 are provided to be placed about an appendage of a user (e.g., a leg, an arm, etc.). In such an embodiment, each of loops 162 and 164 may be placed about the same appendage or separate appendages (e.g., about each leg).

Figure 10:
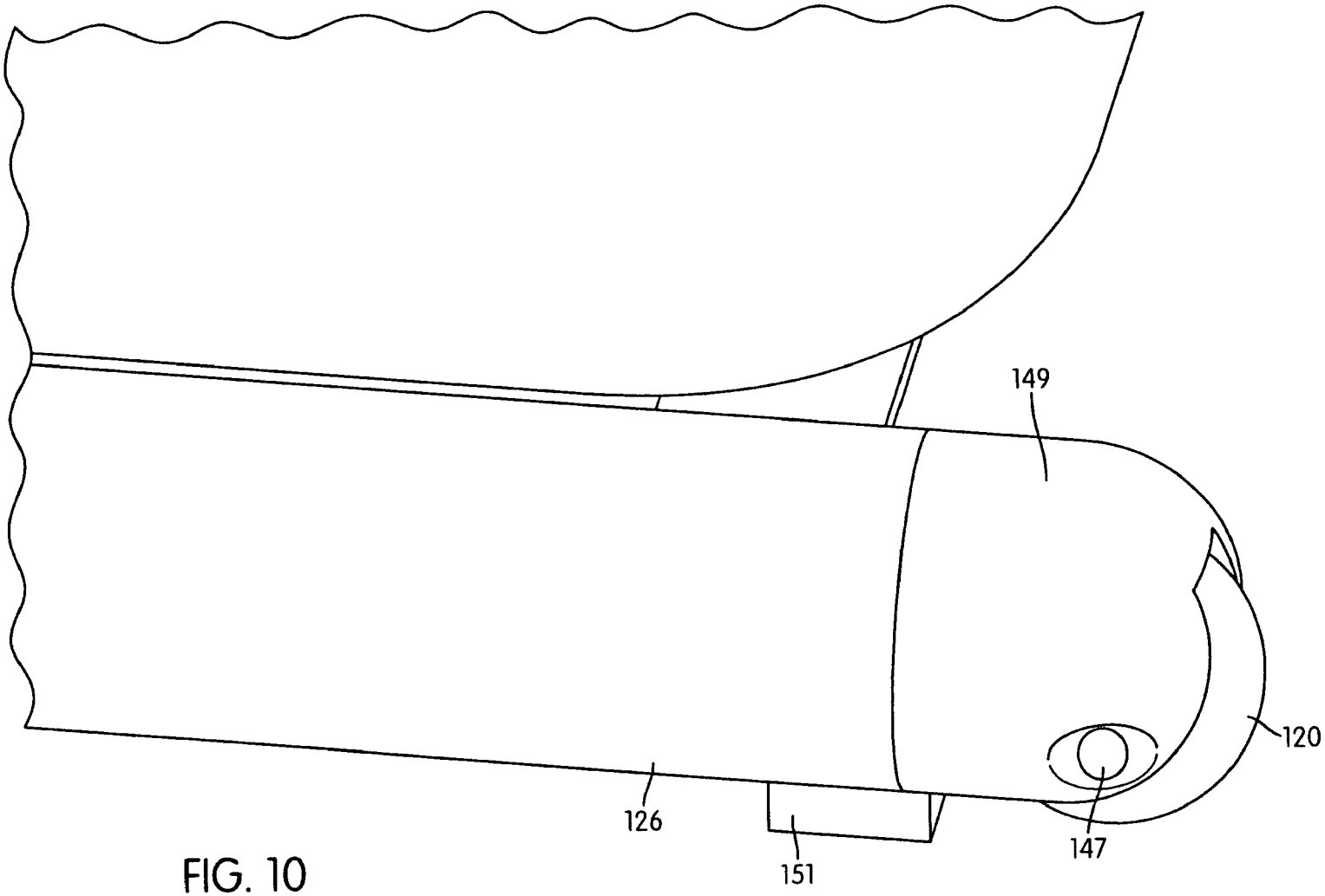
FIG. 10 illustrates a wheel disposed on a portable workout apparatus according to one or more embodiments of the invention.

Returning to FIG. 1, in one embodiment, wheels 120 may enhance the portability of apparatus 110. Wheels 120 may be provided on frame 114. For example, wheels 120 may be provided on base 124. More particularly, wheels 120 may be disposed on base members 126 at the ends of base members 126 that are adjacent to second surface portion 134. Referring to FIG. 10, an exemplary illustration of wheel 120 is provided, according to one embodiment of the invention. In the embodiment shown, wheel 120 is attached to base member 126 an axle 147 about which wheel 120 rotates. A hood 149 covers a portion of wheel 120 such that wheel 120 is substantially hidden from a user that is using apparatus 110. By covering wheel 120 in this manner, hood 149 may protect the user from inadvertently stepping on wheel 120 and/or inadvertently placing his/her hand on wheel 120.

As can be appreciated from FIG. 10, in one embodiment of the invention, a base member support 151 may be disposed on base member 126 adjacent to wheel 120. Base member support 151 may support base member 126 on the floor such that wheel 120 does not engage the floor while apparatus 110 is in use (and/or in storage). In order to engage wheels 120 with the floor to transport apparatus 110, the user tilts apparatus 110 such that the end of base unit 126 opposite the end shown in FIG. 10 is lifted into the air, which in turn will lift base member support 151 off the floor as wheel 120 engages the floor. With apparatus 110 in this position, apparatus 110 may be transported via wheels 120.

In an alternative embodiment, wheels 120 may be movable, with respect to frame 114, between an engaged position and an unengaged position. At the engaged position, wheels 120 may bear some or all of the weight of apparatus 110, and may enable apparatus 110 to be moved with relative ease. At the unengaged position, wheels 120 may be disengaged from the floor so that frame 114 and/or surface 116 may engage the floor and stabilize apparatus 110 for use.

Figure 11:
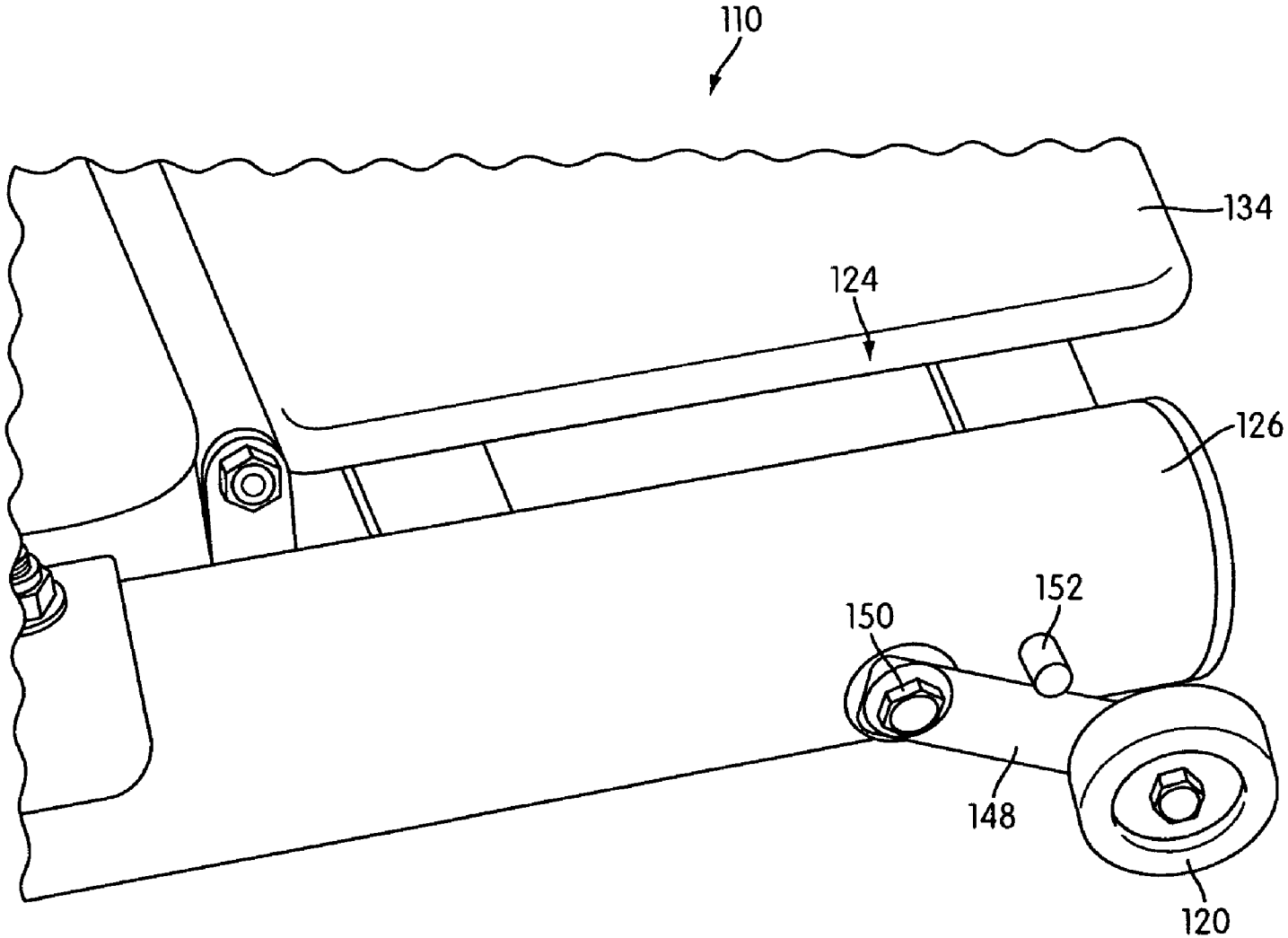
FIG. 11 illustrates a portable workout apparatus including a wheel located in an engaged position according to one or more embodiments of the invention.

FIG. 11 illustrates an exemplary embodiment of apparatus 110 in which wheel 120 may be in the engaged position. Wheel 120 may be secured to a rotatable member 148 that may be secured to frame 114 at an axis of rotation 150. When rotatable member 148 is rotated about axis 150 to bring wheel 120 into the engaged position, a stop 152 may engage rotatable member 148. This may hold wheel 120 in the engaged position while wheel 120 bears some or all of the weight of apparatus 110.

Figure 12:
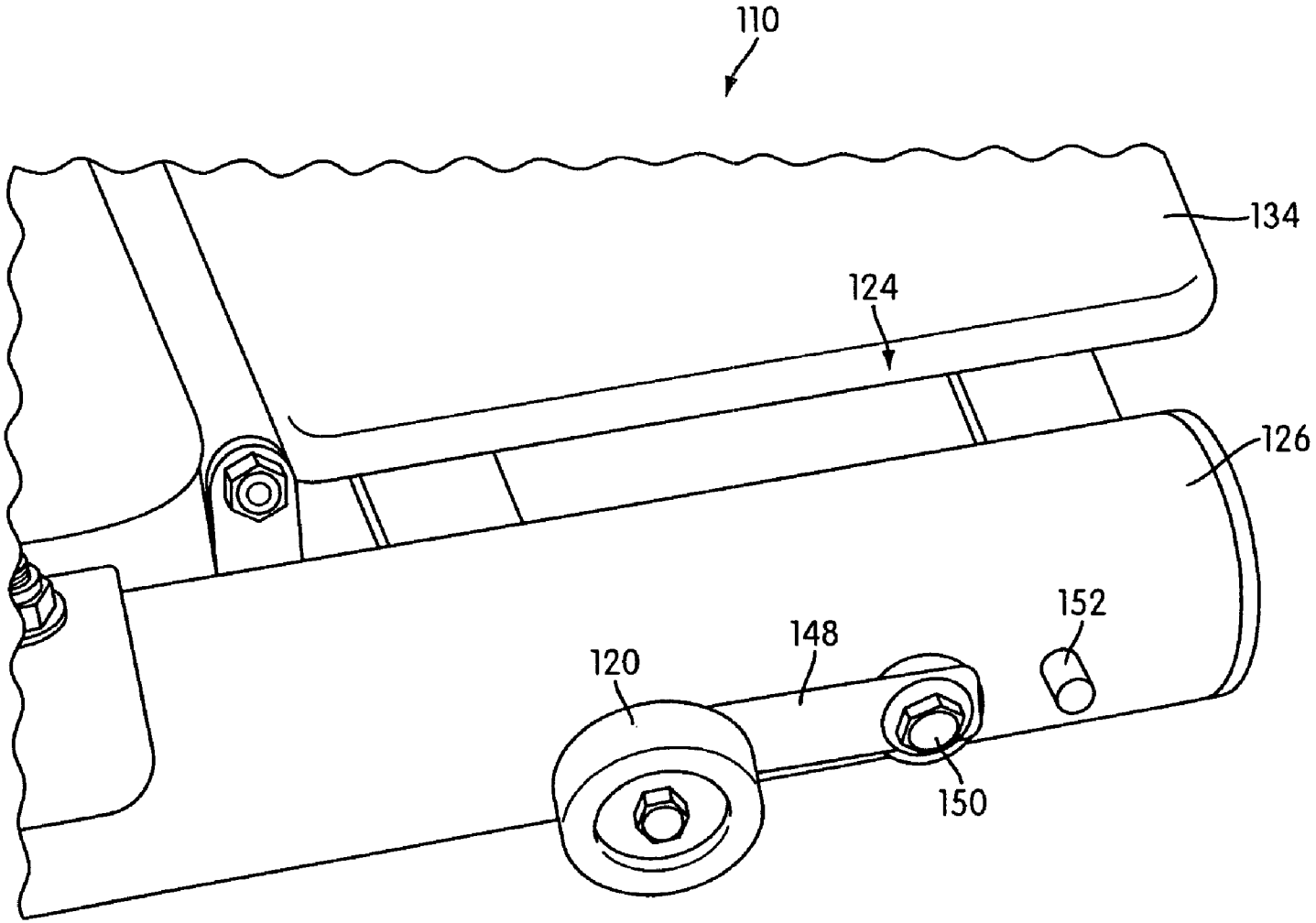
FIG. 12 illustrates a portable workout apparatus including a wheel located in an unengaged position according to one or more embodiments of the invention.

FIG. 12 illustrates an exemplary embodiment of apparatus 110 in which wheel 120 may be in the unengaged position. To bring wheel 120 into the unengaged position, rotatable member 148 may be rotated about axis 150 away from stop 152. In the unengaged position, the weight of apparatus 110 may not be born by wheel 120 because the weight of apparatus 110 causes rotatable member 148, which is not stopped in the unengaged position, to rotate about axis 150 until frame 114 engages the floor and bears the weight of apparatus 110.

Returning to FIG. 1, in some embodiments of the invention, apparatus 110 may include one or more lock or locking mechanisms 138. Locking mechanisms 138 may secure first surface portion 132 in a substantially vertical position for storage and/or secure first surface portion 132 in a substantially horizontal position for use (shown in FIGS. 2-4). In a non-limiting example, locking mechanisms 138 may include a threaded fastener 140, a knob engaging member 154 provided on first surface portion 132, a frame threaded frame opening 156 formed in frame 114, and a receiving tube 142 provided on frame 114. Threaded fastener 140 may include a threaded portion 144 and a knob portion 146. Receiving tube 142 may include a threaded opening.

Figure 13:
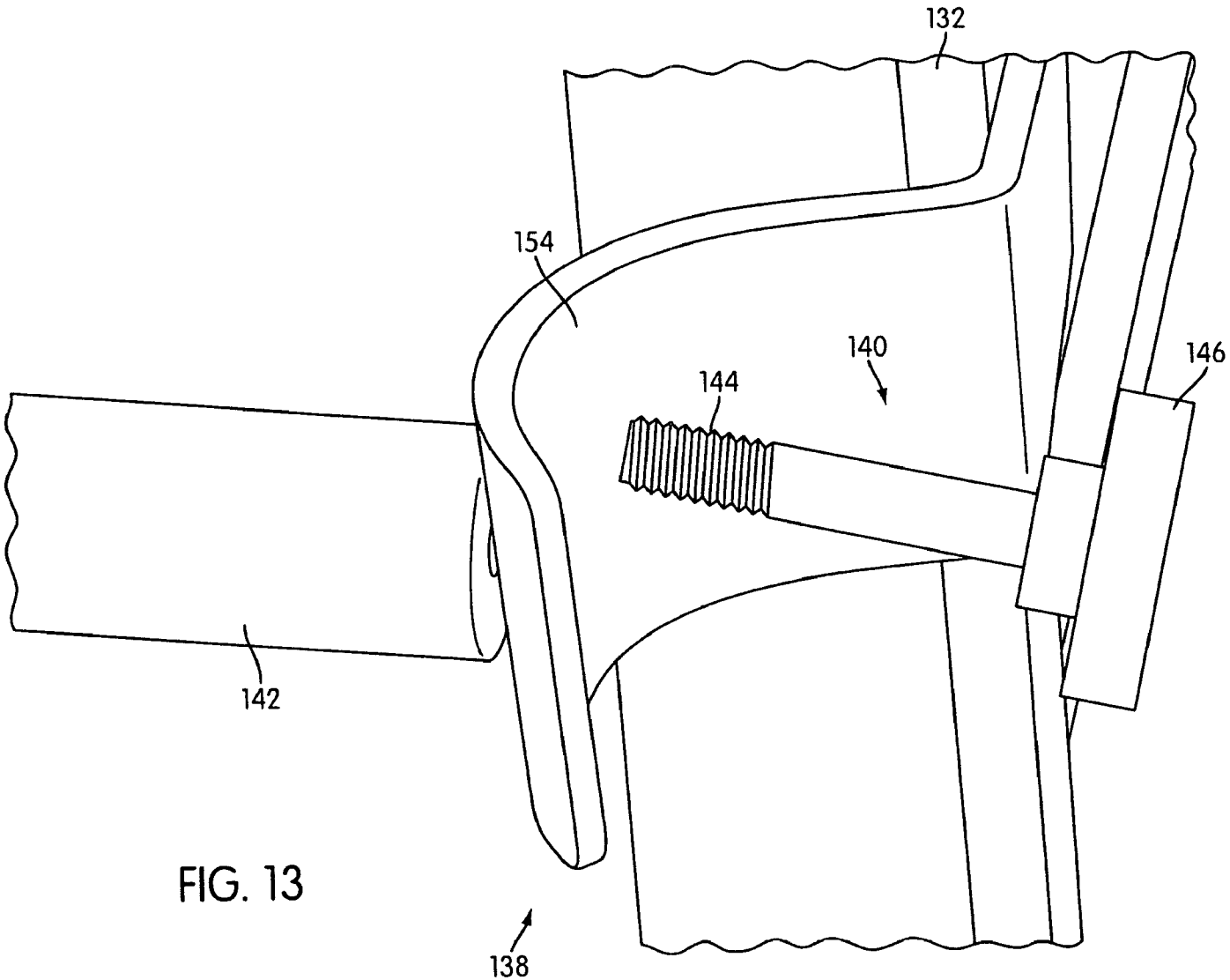
FIG. 13 illustrates a portable workout apparatus including a locking mechanism according to one or more embodiments of the invention.

FIG. 13 illustrates an exemplary embodiment of locking mechanism 138 securing first surface portion 132 in a substantially vertical position (illustrated also, e.g., in FIG. 2). When first surface portion 132 is pivoted into a substantially vertical position, threaded portion 144 of threaded fastener 140 may be introduced into the threaded opening of receiving tube 142. This may cause knob portion 146 of threaded fastener 140 to engage knob engaging member 154 of first surface portion 132, thereby securing first surface portion 132 in the substantially vertical position.

Figure 14:
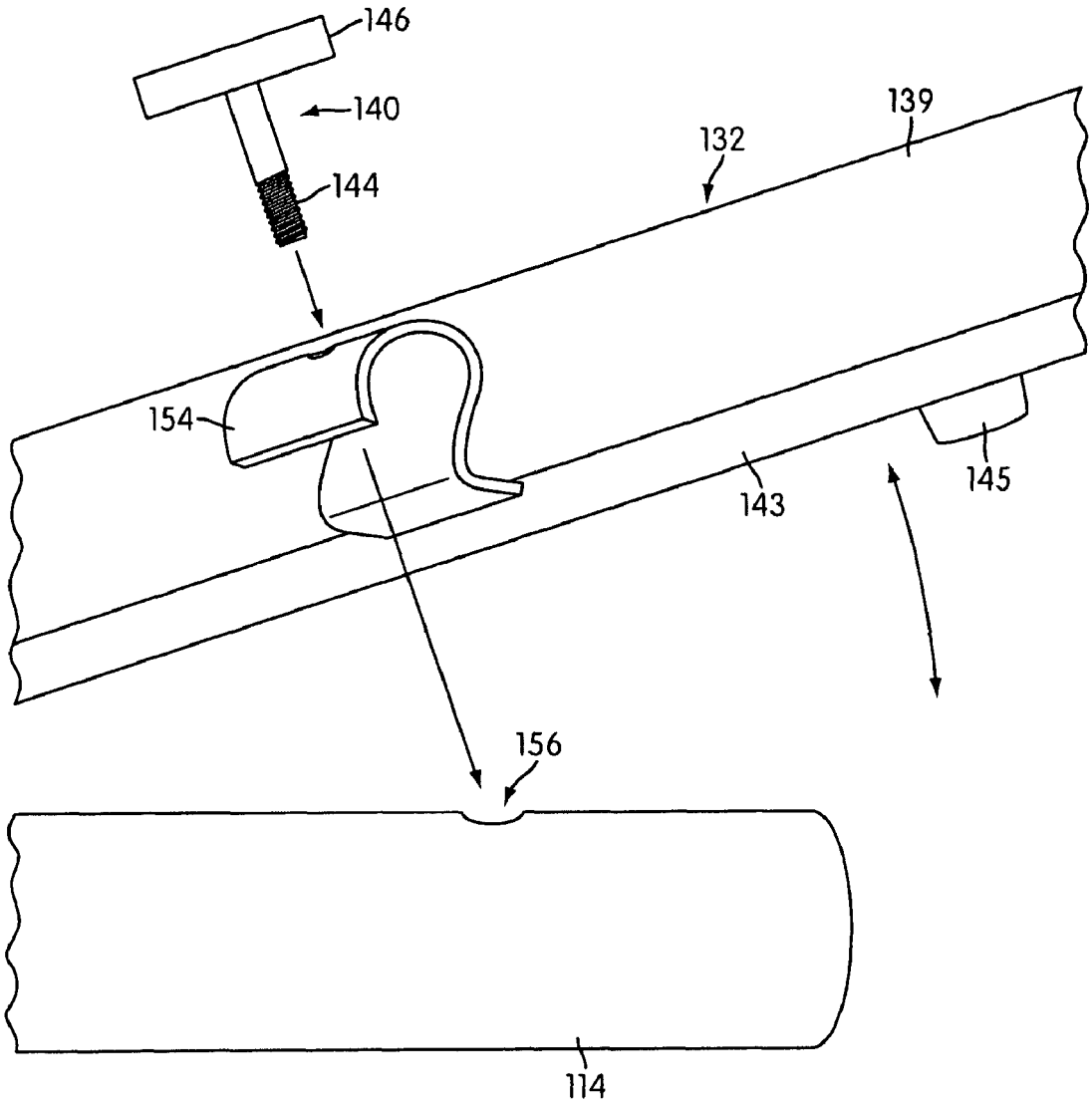
FIG. 14 illustrates a portable workout apparatus including a locking mechanism according to one or more embodiments of the invention.

FIG. 14 illustrates an exemplary embodiment of locking mechanism 138 securing first surface portion 132 in a substantially horizontal position (illustrated also, e.g., in FIG. 1). As first surface portion 132 is pivoted into a substantially horizontal position, threaded portion 144 of threaded fastener 140 may be provided, via knob engaging member 154 to threaded frame opening 156. The may cause knob portion 146 of threaded fastener 140 to engage knob engaging member 154, securing knob engaging member proximate to frame 114, thereby securing first surface portion 132 in a substantially horizontal position. Fixing first surface portion 132 to frame 114 for use may enhance the stability of apparatus 110, by increasing the effective footprint of frame 114, enabling a body weight of the user to provide ballast directly (or substantially directly) to frame 114, or may otherwise enhance the stability of apparatus 110.

Figure 15:
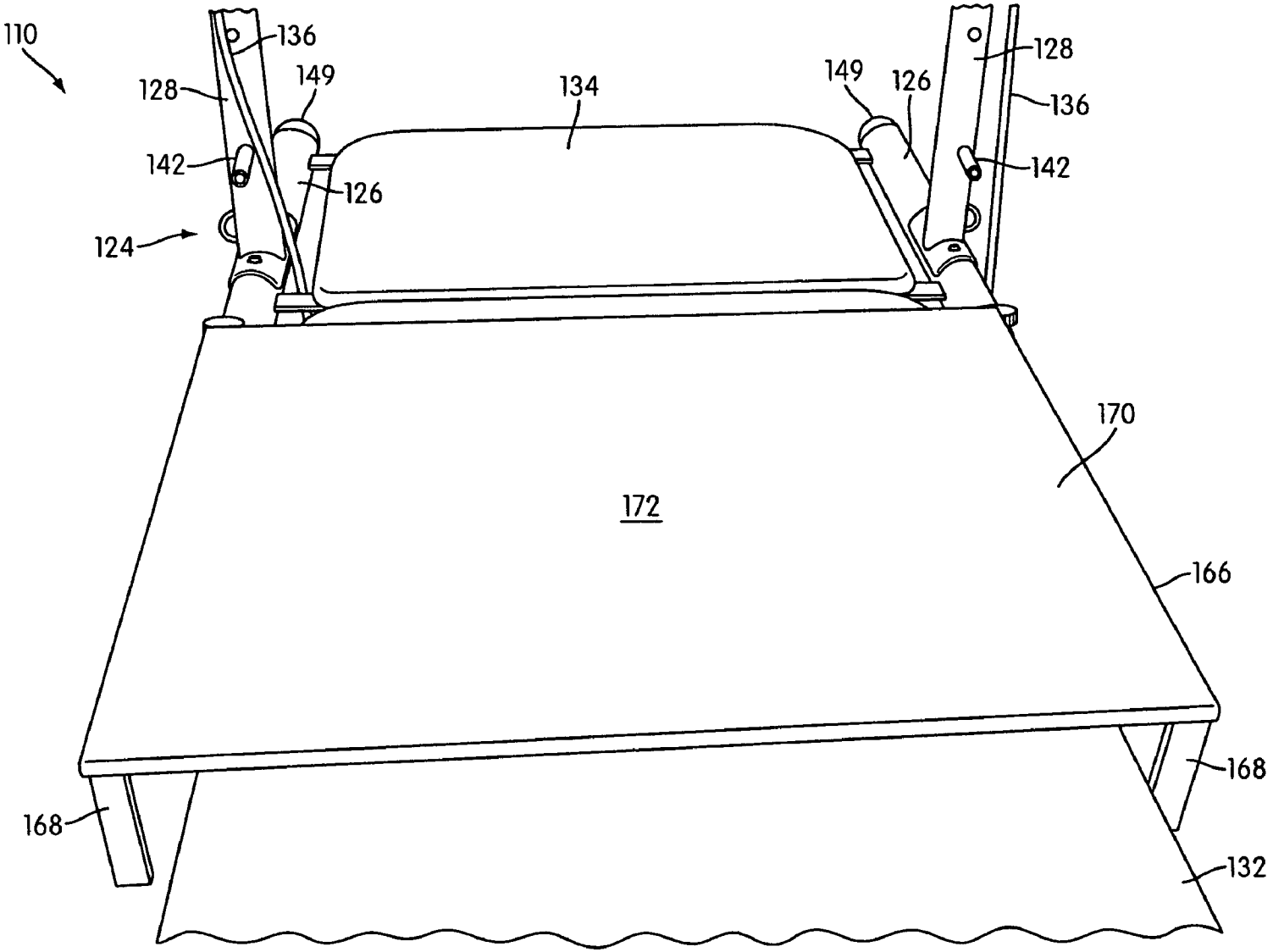
FIG. 15 illustrates a platform for use with a portable workout apparatus according to one or more embodiments of the invention.

FIG. 15 is an illustration of a rigid platform 166 for use with apparatus 110, in accordance with one embodiment of the invention. Platform 166 includes supports 168 that support a planar member 170 just above first surface portion 132. Planar member 170 provides a substantially planar surface 172 that is rigid. Planar member 170 is formed with dimensions such that supports 168 engage the floor on each side of first surface portion 132. In one embodiment, planar member 170 is formed from wood. In other embodiments, planar member 170 may be formed from other rigid materials. By placing platform 166 over first surface portion 132, a user is able to have a rigid surface on which to stand, kneel, lie, etc. while exercising, rather than the padded surface provided by first surface portion 132.

As can be appreciated from FIG. 15, platform 166 can selectively be provided in place above first surface portion 132 at virtually any location along first surface portion 132 at which the user intends to exercise (e.g., stand, kneel, lie, etc.). Platform 166 can also be provided on the other side of opening 122, above second surface portion 134, should the user desire a rigid surface on that side of opening 122.

Figure 16:
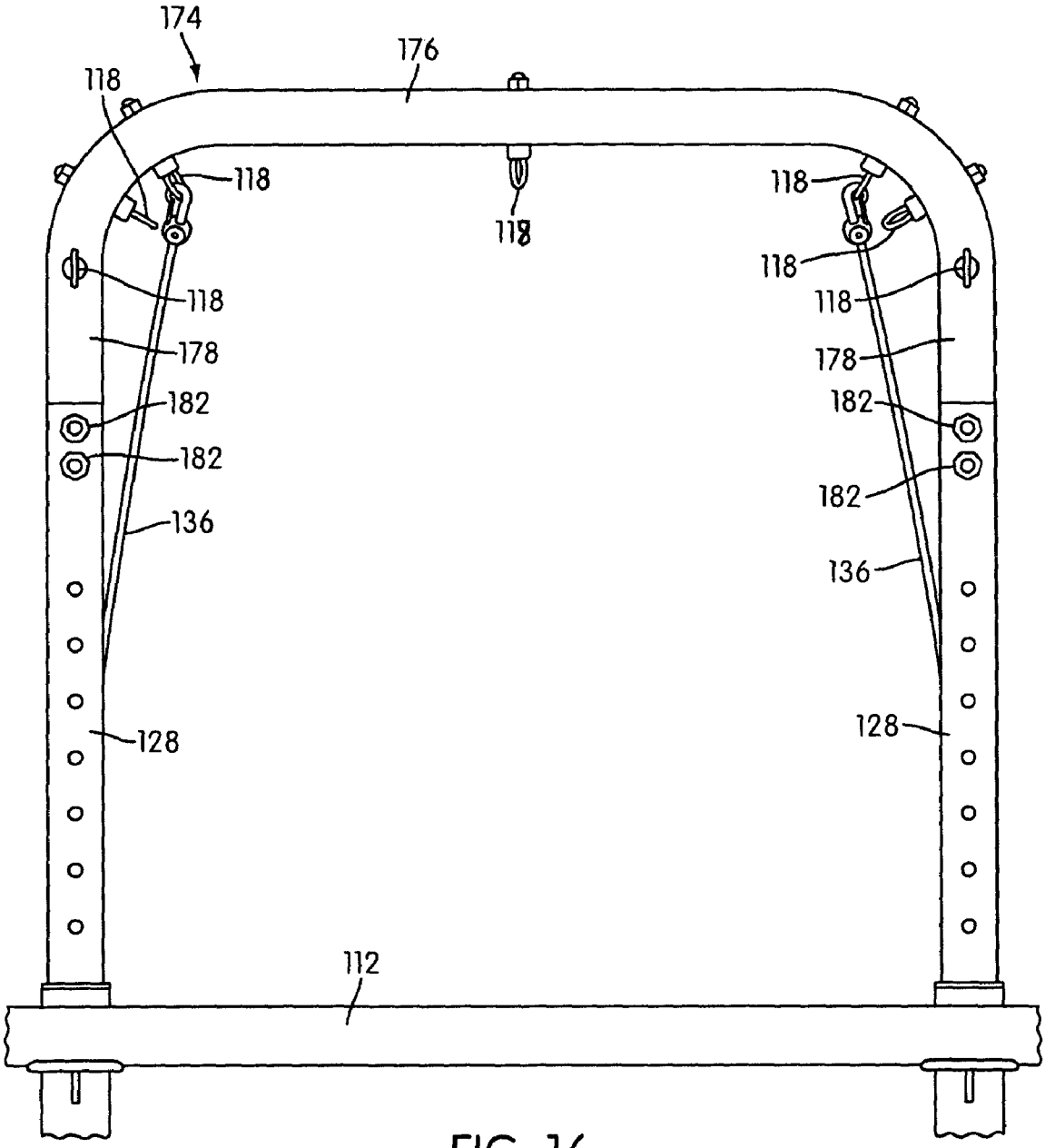
FIG. 16 illustrates an attachment for use with a portable workout apparatus according to one or more embodiments of the invention.

Referring to FIG. 16, an attachment 174 that is removably installed on apparatus 110, according to one embodiment of the invention. In the embodiment shown, attachment 174 is generally U-shaped with a horizontal member 176 that runs between side members 178. A plurality cord brackets 118 are disposed on attachment 174 that enable resistance cords 136 to be removably coupled to attachment 174. As is evident in FIG. 16, when attachment 174 is installed on apparatus 110, side members 178 extend out of support members 128 and horizontal member 176 runs generally horizontally above the tops of support members 128.

Figure 17:
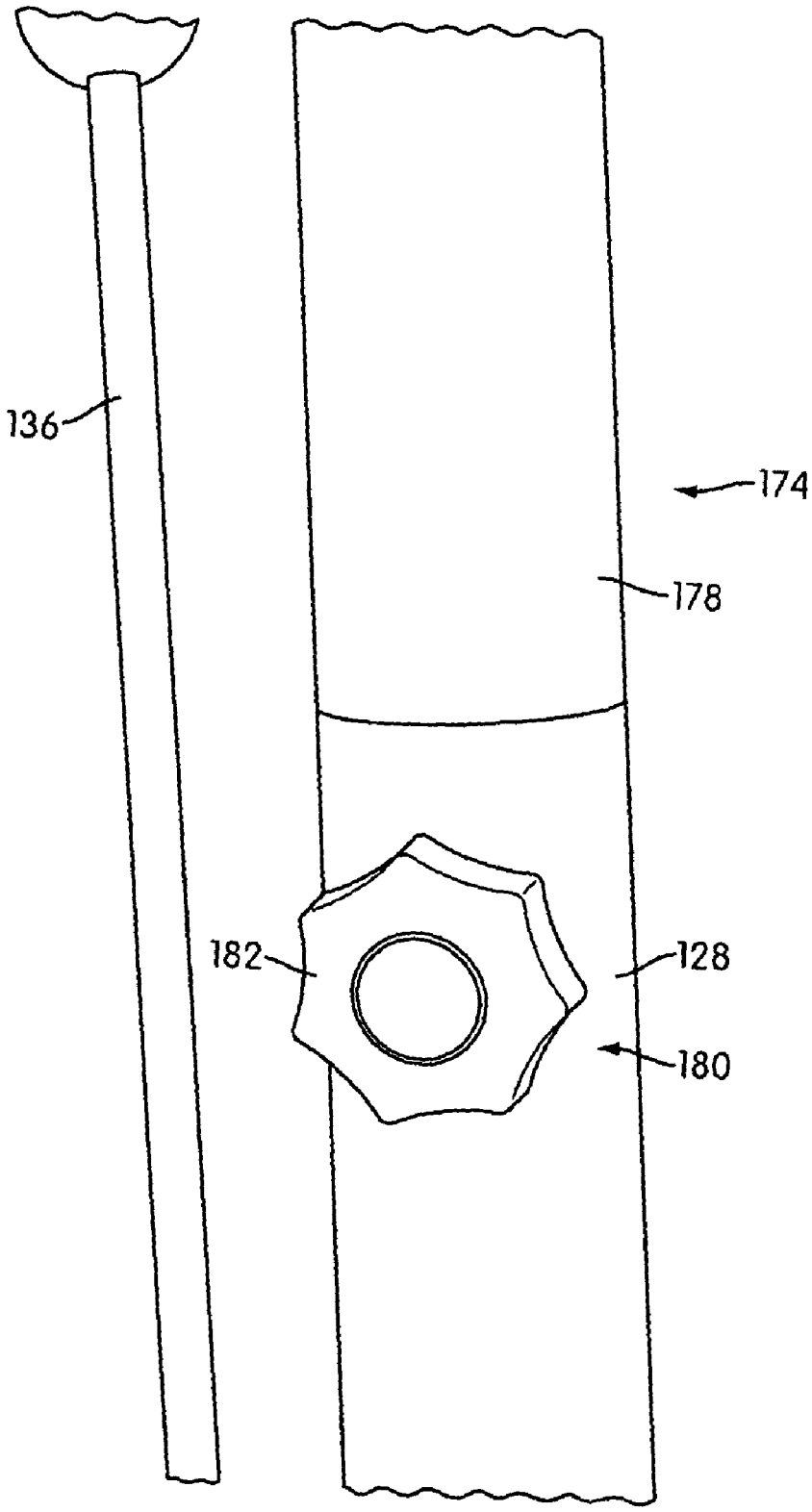
FIG. 17 illustrates an engagement between an attachment and a portable workout apparatus according to one or more embodiments of the invention.

Turning to FIG. 17, to removably install attachment 174 on apparatus 110, distal portions of side members 178 are inserted into support members 128. In one embodiment, in order to secure the distal portions of side members 178 within support members 128, one or more fasteners 180 may be screwed into openings in the sides of support members 128 until fasteners 180 engage the distal ends of side members 178. Fasteners 180 may include knobs 182 that are provided as grips to facilitate the engagement of fasteners 180 by the user as the user tightens fasteners 180 into the distal portions of side members 178. In another embodiment, openings are formed in the sides of the distal portions of side members 178 that correspond to the openings form in the sides of support members 128. To secure the distal ends within support members 128, the openings in the distal portions of side members 178 and the openings in support members are aligned and pins are inserted through the aligned openings.

It can thus be appreciated that embodiments of the present invention have now been fully and effectively accomplished. The foregoing embodiments have been provided to illustrate the structural and functional principles of the present invention, and are not intended to be limiting. To the contrary, the present invention is intended to encompass all modifications, alterations and substitutions within the spirit and scope of the appended claims.

What is claimed is:

1. A portable workout apparatus comprising:

a bar held at an adjustable bar height;

a frame that supports the bar at the adjustable bar height;

a padded structure secured to the frame, said padded structure having a first portion and a second portion, said first and second portions having a deployed position forming an approximately horizontal surface that is disposed on opposite sides of a vertical plane defined by the bar, wherein the approximately horizontal surface generally forms an opening with the bar and the frame that is adapted to accommodate a user therethrough, wherein the first portion includes a pivotal connection that enables the first portion to pivot, relative to the second portion, about an axis of rotation that is substantially parallel to the bar and fixed with respect to the frame, and wherein the pivotal connection enables the first portion to pivot from the deployed position to a storage position such that a footprint of the apparatus is decreased for storage; and a ground contacting surface disposed on an underside of the first portion such that the ground contacting surface contacts the ground and supports the first portion on the ground when the first portion is in the deployed position, wherein the ground contacting surface is disengaged from the ground by pivotal movement of the first portion about the axis of rotation from the deployed position to the storage position.

2. A portable workout apparatus comprising:

a bar held at an adjustable bar height;

a frame that supports the bar at the adjustable bar height; and a padded structure that sits on the ground, the padded structure forming a padded surface that runs transverse to a vertical plane defined by the bar, the padded surface extending from both sides of the vertical plane defined by the bar, wherein the padded surface generally forms an opening with the bar and the frame that is adapted to accommodate a user therethrough, the frame being connected to the padded structure such that the connection between the frame and the padded structure stabilizes the frame under loads applied by a user to the bar, wherein the padded structures comprises a first portion and a second portion, the first portion comprising a pivotal connection that enables the first portion to pivot with respect to the second portion about an axis of rotation that is substantially parallel to the bar, and wherein the first portion is pivotal about the axis of rotation from a deployed position in which the first portion and the second portion form the padded surface to a storage position in which the first portion of the padded structure is disengaged from the ground and the footprint of the apparatus is decreased for storage.

* * * * *